US005893281A

United States Patent [19]

Teich

[11] Patent Number: 5,893,281

[45] Date of Patent: Apr. 13, 1999

[54] TETHERING SYSTEM FOR A CLOTHES WASHING MACHINE HAVING A HUNG-STRUT SUSPENSION

[75] Inventor: Daniel E. Teich, Marion, Ill.

[73] Assignee: Maytag Corporation, Newton, Iowa

[21] Appl. No.: 08/965,883

[22] Filed: Nov. 7, 1997

[51] Int. Cl.[6] ..... D06F 37/34

[52] U.S. Cl. ..... 68/23.3; 494/82; 210/144; 68/23.2

[58] Field of Search ..... 68/23.2, 23.3, 68/23.4; 494/82; 210/144; 8/158, 159

[56] References Cited

U.S. PATENT DOCUMENTS

| | | | |
|---|---|---|---|
| 2,976,998 | 3/1961 | Smith | 210/78 |
| 2,987,189 | 6/1961 | Evjen | 68/23.2 |
| 3,021,956 | 2/1962 | Bochan | 68/23.3 |
| 3,151,074 | 9/1964 | Gooch . | |
| 3,346,115 | 10/1967 | Mellinger . | |
| 3,361,398 | 1/1968 | Brinkman et al. | 248/18 |
| 3,939,674 | 2/1976 | Czech et al. | 68/23.3 |
| 4,625,529 | 12/1986 | Anderson | 68/23.3 |
| 5,520,029 | 5/1996 | Savkar | 68/23 |
| 5,528,913 | 6/1996 | Savkar | 68/23.3 |

FOREIGN PATENT DOCUMENTS

| | | | |
|---|---|---|---|
| 207152 | 5/1956 | Australia | 68/23.2 |
| 1186413 | 1/1965 | Germany | 68/23.2 |
| 63-15998 | 1/1988 | Japan | 68/23.3 |
| 63-35291 | 2/1988 | Japan | 68/23.3 |
| 63-194698 | 8/1988 | Japan | 68/23.2 |

*Primary Examiner*—Frankie L. Stinson

*Attorney, Agent, or Firm*—Zarley, McKee, Thomte, Voorhees & Sease

[57] ABSTRACT

A tethering system is provided for a washing machine having a hung strut suspension. The tethering system includes a pair of pulleys or cams pivotally mounted in the cabinet. A pair of subframe straps are secured between the cams and the subframe of the hung assembly. An anti-rotation strap extends partially around the tub with opposite ends secured to the cams. When the tub of the machine is filled with water, the hung assembly moves downwardly due to the weight of the water, thereby rotating the cams which tighten the anti-rotation strap into frictional engagement with the tub. Thus rotation and oscillation of the tub is prevented during the agitation and low speed spin cycles of the machine.

23 Claims, 3 Drawing Sheets

TETHERING SYSTEM FOR A CLOTHES WASHING MACHINE HAVING A HUNG-STRUT SUSPENSION

BACKGROUND OF THE INVENTION

In a washing machine having a hung strut suspension, the tub, basket, motor, and drive train are mounted on a subframe to form an assembly which is hung or suspended from struts that are mounted to the cabinet of the machine. This suspended assembly is free to rotate and oscillate during the agitation and spin cycles of the machine. Due to the freedom of rotation of a hung-strut suspension, during agitation there is unacceptable oscillatory motion of the hung-strut suspension. When a braking torque is applied to retard the spinning motion of the internal wash basket, the suspended assembly will tend to wind-up on the struts. If such wind-up rotation is not restrained during braking, the entire assembly will move vertically upward as it winds up on the struts, and thereby cause damage to the cabinet and other components.

Current washing machines having a hung-strut suspension utilize a tethering system to restrain the rotational motion of the hung assembly with respect to the outer cabinet of the washing machine during the agitation, spin and braking operations. Typically, a stretchable tether is connected from each of the four top corners of the cabinet to points on the outer perimeter or periphery of the hung assembly. The resistance imparted by the stretchable tether straps will limit rotational and oscillatory motion of the hung assembly. A problem with the conventional tethering system having stretchable tether straps is that over time, the straps lose elasticity and thereby tend to lengthen to an extent that they do not function to prevent undesirable rotation or oscillation of the hung assembly.

Therefore, a primary objective of the present invention is the provision of an improved tethering system for a washing machine having a hung-strut suspension.

Another objective of the present invention is the provision of a tethering system for a washing machine with a hung-strut suspension which includes an anti-rotation strap extending around the tub for frictional engagement when the hung assembly moves downwardly in response to a water load.

A further objective of the present invention is the provision of a tethering system for a hung-strut suspension washing machine wherein camming action is utilized to engage an anti-rotation strap with the tub to prevent rotation and oscillation thereof.

Still a further objective of the present invention is the provision of an improved method of tethering a tub of a clothes washing machine having a hung-strut suspension.

A further objective of the present invention is the provision of a tethering system for the hung assembly of a washing machine which is economical to manufacture and durable and effective in use.

These and other objectives will become apparent from the following description of the invention.

SUMMARY OF THE INVENTION

An improved tethering system is provided for a washing machine having a hung-strut suspension. The washing machine includes a conventional cabinet with the hung assembly being suspended from the cabinet. The hung assembly includes a tub, a perforated basket rotatably mounted within the tub, a motor and drive train for rotating the basket, and a subframe for supporting the motor, drive train, tub and basket. A plurality of struts extend between the subframe and the cabinet to suspend the assembly within the cabinet.

The tethering system includes a pair of pulleys or cams pivotally mounted in the cabinet. A pair of straps extend between the cams and the subframe. An anti-rotation strap extends around the tub with opposite ends being secured to each of the pulleys or cams. When the tub is filled or partially filled with water, the weight or load of the water will move the hung assembly downwardly, thereby rotating the pulleys or cams via the first straps. Such rotation of the cams tightens the anti-rotation strap into frictional engagement with the tub, thereby inhibiting rotation and oscillation of the tub during the agitation cycle of the machine. When the spin cycle begins to discharge water from the tub, the decreased weight in the tub allows the hung assembly to rise such that torsion springs on the cam shafts return the cams to their original position, thereby loosening the anti-rotation strap out of engagement with the tub, such that the hung assembly is free to oscillate during high speed spin. When braking action is applied to slow down the spin, the braking torque produces a reactive rotation torque on the assembly which again moves downwardly, thereby pulling the anti-rotation strap into frictional engagement with the tub to prevent rotation and oscillation.

DETAILED DESCRIPTION OF THE DRAWINGS

Figure 1:
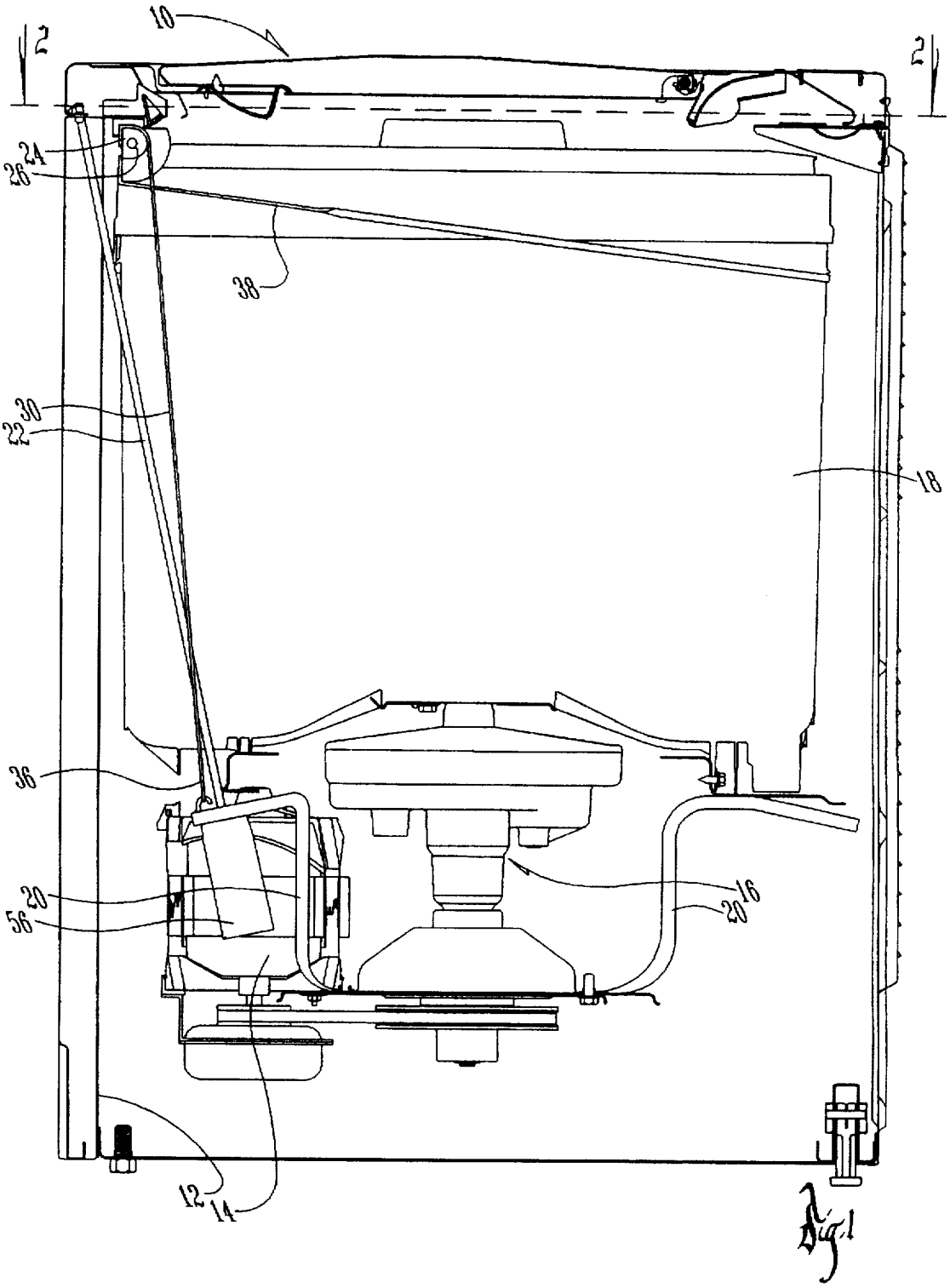
FIG. 1 is a side elevation view of a washing machine with a hung-strut suspension, and showing the tether system of the present invention.

In the drawings, the reference numeral 10 designates a clothes washing machine having a hung-strut suspension. The clothes washing machine 10 includes a cabinet 12, a motor 14, a drive train 16 operatively connected to the output shaft of the motor 14, a perforated basket (not shown) mounted within a tub 18 for rotation therein, and a subframe 20 for supporting the motor 14, the drive train 16, the basket, and the tub 18. A plurality of struts 22 extend between the subframe 20 and the cabinet 12 so as to suspend the hung assembly comprising the motor 14, the drive train 16, the basket, the tub 18, and the subframe 20. The structure and function of these components is conventional and does not constitute a part of the present invention.

The present invention is directed towards a tethering system for the hung assembly. More particularly, the tethering system includes a pair of pulleys or cams 24 each being pivotally mounted upon a shaft 26 which is mounted to the cabinet 12 adjacent the upper rear corners. A torsion spring 28 is provided on the shaft to normally urge the cam 24 to the non-functional position shown in FIG. 3. A subframe strap 30 extends between each cam 24 and the subframe 20. More particularly, the first end 32 of each of the subframe straps 30 is secured to the cam 24 and extends around a first cam surface 34. The second end 36 of each subframe strap 30 is attached to the subframe 20. The subframe straps 30 can be made of an inelastic material, but if they are, a spring (not shown) should be attached between the subframe 20 and the ends of the subframe straps 30 to allow for tolerances and differential in the drop that the tub may experience. If strap 30 is made of an elastic material, the elasticity would provide the spring force.

Figure 3:
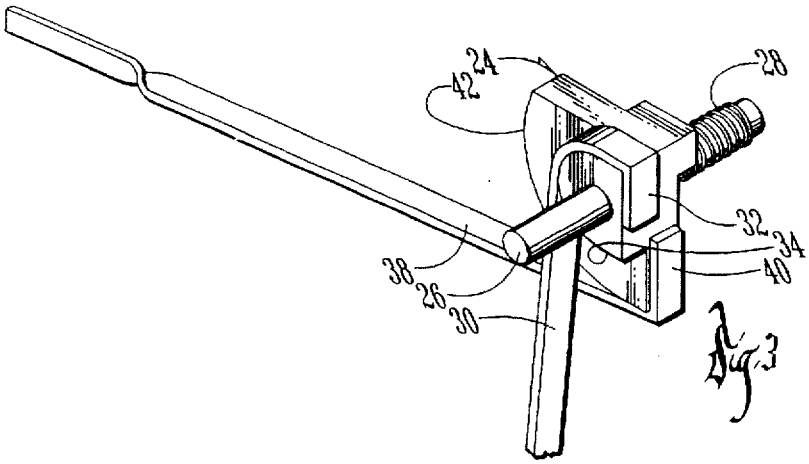
FIG. 3 is a partial enlarged perspective view of one of the cams and straps of the tethering system of the present invention in a non-functional position.
Figure 4:
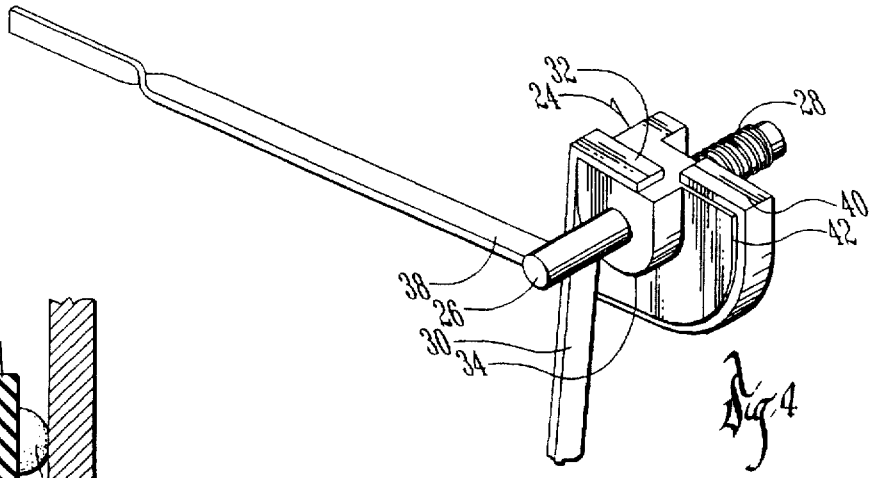
FIG. 4 is a view similar to FIG. 3 showing the tether system in a functional position.

An anti-rotation strap 38 extends between the two cams 24. More particularly, the ends 40 of the anti-rotation strap 38 are connected to the cams 24 and extend around a second cam surface 42. As seen in FIGS. 3 and 4, the subframe straps 30 and the anti-rotation strap 38 extend in opposite directions around the respective cam surfaces 34, 42. Preferably, the diameter of the second cam surface 42 is greater than the diameter of the first cam surface 34, such that each cam 24 defines a multiplier pulley. Alternatively, the first and second cam surfaces 34, 42 may have the same diameter without departing from the scope of the present invention.

Figure 2:
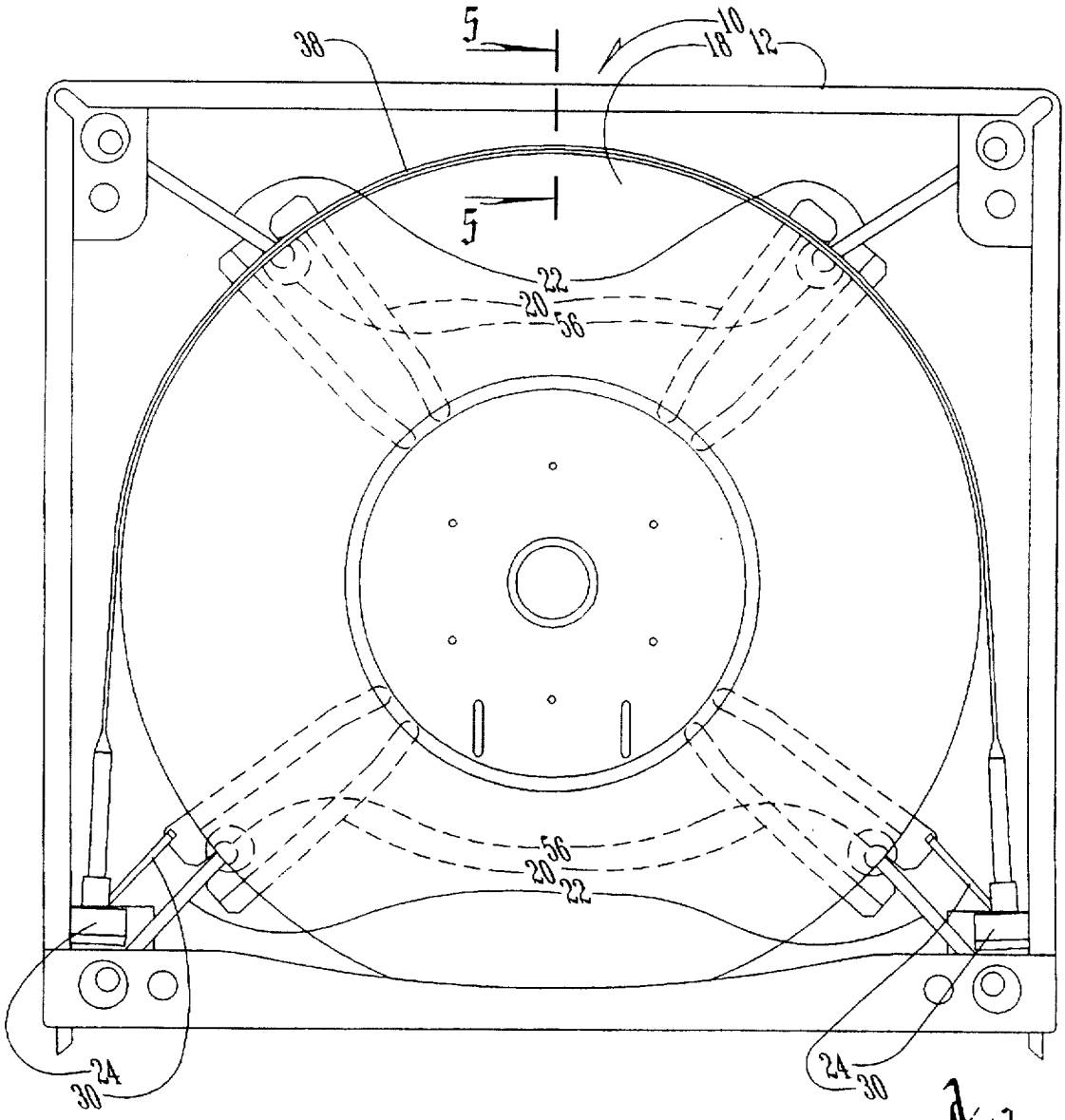
FIG. 2 is a top sectional view taken along lines 2—2 of FIG. 1 and rotated 90° counterclockwise.
Figure 5:
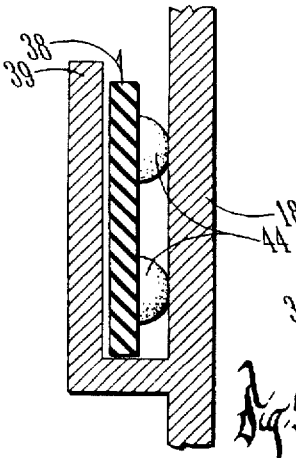
FIG. 5 is a partial sectional view taken along lines 5—5 of FIG. 2 showing one embodiment of friction engaging members of the anti-rotation strap.
Figure 6:
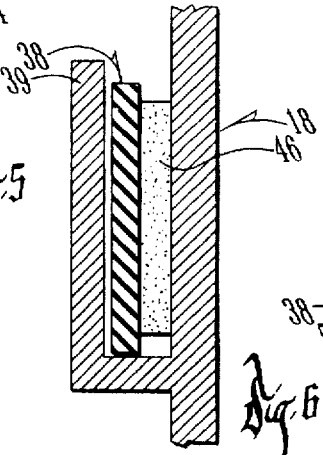
FIG. 6 is a view similar to FIG. 4 showing a second embodiment of a friction member of the anti-rotation strap.
Figure 7:
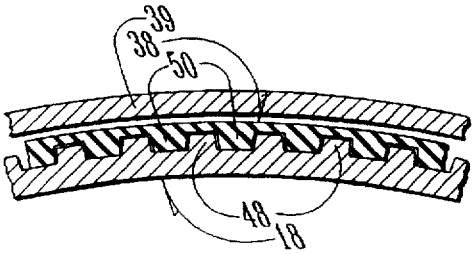
FIG. 7 is a partial sectional view showing a third embodiment wherein the tub and anti-rotation strap have interlocking teeth.
Figure 8:
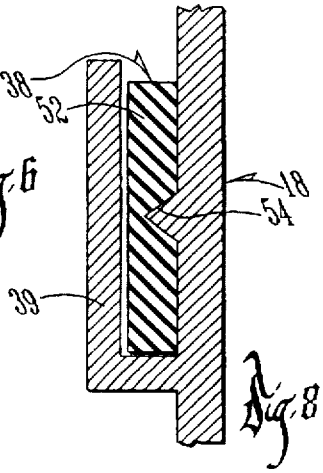
FIG. 8 is a partial sectional view showing a fourth embodiment wherein the tub and anti-rotation strap have a matable boss and notch.

As best seen in FIG. 2, the anti-rotation strap is engagable with the tub 18 for a distance of approximately 180°. The strap 38 may directly engage the tub, or may have friction engaging members. For example, in FIG. 5, a plurality of rubber bumpers 44 are provided on the strap 38 for enhancing the frictional engagement with the tub 18. Alternatively, a brake pad 46 may be provided on the strap 38, as shown in FIG. 6. As a further alternative, the tub 18 and the strap 38 may be provided with engagable teeth 48, 50, respectively, as shown in FIG. 7. A further embodiment is shown in FIG. 8 wherein the tub includes a boss 52 and the strap includes a notch 54, with the boss and notch being matable with one another for frictional engagement between the strap 38 and the tub 18. In embodiments utilizing rubber bumpers 44 and brake pad 46, the anti-rotation strap 38 can be inelastic since the friction of the bumpers 44 and brake pad 46 will dissipate inertial energy when braking. With embodiments utilizing teeth 48, 50 and notches 54, the anti-rotation strap 38 needs to be slightly elastic to dissipate energy. Alternatively, a spring may be added to one end of the anti-rotation strap 38.

As further shown in FIGS. 2 and 5–8, a channel or ledge 39 is incorporated into the tub 18 to locate the strap 38 during spin. The channel 39 is incorporated into a 90° segment of the upper portion of the tub 18 centered on the side of the tub opposite the pulleys 24.

The tethering system of the present invention moves between non-functional and functional conditions, as shown in FIGS. 3 and 4, respectively. The functional states exist during the washing machine agitation cycle, the initial portions of the spin cycles, and during spin braking.

More particularly, when the tub 18 of the hung assembly fills with water, the weight of the water moves the hung assembly downwardly with respect to the cabinet 12. The magnitude of this vertical movement is limited by a piston 56. As the hung assembly moves downwardly, the subframe straps 30 pivot the cams 24 about the axis of the shafts 26, which in turn winds the ends 40 of the anti-rotation strap 38 upon the second cam surface 42 of the cams 24. Thus, the downward movement of the hung assembly tightens or pulls the anti-rotation strap 38 into frictional or mechanical engagement with the tub 18 to eliminate relative motion between the anti-rotation strap 38 and the hung assembly. The rubber bumpers 40, brake pad 46, teeth 48, 50, and boss 52/notch 54 provide alternative means to assure the prevention of movement between the anti-rotation strap 38 and the hung assembly.

Accordingly, during the agitation cycle of the washing machine 10, the hung assembly is restrained by the anti-rotation strap 38 from rotation and oscillation.

As the agitation cycle is completed and the spin cycle begins, rotation and oscillation of the hung assembly is prevented by the engaged anti-rotation strap 38. As water spins out of the tub 30 with increasing rotational spin speed, the hung assembly will move upwardly, thereby disengaging the anti-rotation strap 38 from the tub 18 as the cams 24 pivot back to their original position due to the restoring torque imparted by the torsion spring 28. Accordingly, during the high speed spin cycle, the hung assembly is free to oscillate.

As a braking force is applied at the completion of the spin cycle, a reactive rotational force is generated on the hung assembly. Cams 32 and 42 are momentarily caused to rotate because the subframe straps 30 are pulled when the entire hung assembly rotates. The rotation of cams 32 and 42 will cause the anti-rotation strap 38 to momentarily engage the tub 18 to effectively limit the reactive rotation of the hung assembly.

Whereas the invention has been shown and described in connection with the preferred embodiments thereof, it will be understood that many modifications, substitutions, and additions may be made which are within the intended broad scope of the following claims. For example, the engagement and disengagement of the anti-rotation strap 38 with the tub 18 may be accomplished with a single cam on one end of the strap, with the opposite strap end being fixed. From the foregoing, it can be seen that the present invention accomplishes at least all of the stated objectives.

What is claimed is:

1. A tethering system for a washing machine including a cabinet, a tub for holding water, a perforated basket mounted within the tub, a motor, a drive train interconnecting the motor and basket for rotating the basket within the tub, a subframe for supporting the tub, basket, motor and drive train; and a hung strut suspension for suspending the subframe within the cabinet; the tethering system comprising:

a pair of pulleys mounted on the cabinet for rotation about an axis, each pulley having first and second cam surfaces;

a pair of first straps each having a first end secured to the first cam surface of one of the pulleys and a second end secured to the subframe; and an anti-rotation strap extending at least partially around the tub and having opposite ends secured to the second cam surface of each pulley;

whereby upon downward movement of the subframe, the first straps will rotate the pulleys to tighten the anti-rotation strap into engagement with the tub to inhibit rotation of the tub.

2. The tethering system of claim 1 wherein the anti-rotation strap includes a braking element for enhanced frictional engagement with the tub.

3. The tethering system of claim 2 wherein the braking element is a plurality of rubber bumpers.

4. The tethering system of claim 2 wherein the braking element is a brake pad.

5. The tethering system of claim 1 further comprising matable male and female portions on the tub and anti-rotation strap.

6. The tethering system of claim 1 further comprising interlockable teeth on the tub and anti-rotation strap.

7. The tethering system of claim 1 wherein the first cam surface of each pulley has a smaller radius than the second cam surface.

8. The tethering system of claim 1 wherein the pulleys are multiplier pulleys.

9. The tethering system of claim 1 wherein the first straps and anti-rotation strap are not stretchable.

10. A clothes washing machine, comprising:

a cabinet;

a hung assembly suspended in the cabinet;

a pair of cams pivotally mounted in the cabinet;

a pair of first straps having one end connected to each of the cams and extending around the cams in one direction, with a second end operatively connected to the hung assembly;

an anti-rotation strap extending around the hung assembly and having opposite ends connected to each of the cams so as to extend around the cams in a direction opposite the first straps;

whereby downward movement of the hung assembly pivots the cams via the first straps, thereby wrapping the anti-rotation strap upon the cams such that the anti-rotation strap is moved into engagement with the hung assembly to prevent rotation thereof.

11. The washing machine of claim 10 wherein the anti-rotation strap includes rubber members for frictionally engaging the hung assembly.

12. The washing machine of claim 10 wherein the anti-rotation strap includes a brake pad for frictionally engaging the hung assembly.

13. The washing machine of claim 10 wherein the hung assembly and anti-rotation strap each have a plurality of teeth which are interlockable upon sufficient downward movement of the hung assembly.

14. The washing machine of claim 10 wherein the tub and anti-rotation strap each have one of a boss and a notch which are matable upon sufficient downward movement of the hung assembly.

15. The washing machine of claim 10 wherein each cam has a small cam surface to which the first end of the first strap is secured and a large cam surface to which one end of the anti-rotation strap is secured.

16. The washing machine of claim 10 wherein the first straps and anti-rotation strap are not stretchable.

17. The washing machine of claim 10 wherein the anti-rotation strap extends approximately 180° around the hung assembly.

18. A clothes washing machine, comprising:

a cabinet;

a hung assembly suspended in the cabinet;

a cam pivotally mounted in the cabinet;

a first strap having one end connected to the cam and extending around the cam in one direction, with a second end operatively connected to the hung assembly;

an anti-rotation strap extending around the hung assembly and having opposite ends connected to the cam so as to extend around the cam in a direction opposite the first strap;

whereby downward movement of the hung assembly pivots the cam via the first strap, thereby wrapping the anti-rotation strap upon the cam such that the anti-rotation strap is moved into engagement with the hung assembly to prevent rotation thereof.

19. The washing machine of claim 18 wherein the cam has a small cam surface to which the first end of the first strap is secured and a large cam surface to which one end of the anti-rotation strap is secured.

20. Washing machine of claim 18 wherein the first strap and anti-rotation strap are not stretchable.

21. The washing machine of claim 18 wherein the anti-rotation strap extends around substantially 180° of the hung assembly.

22. The washing machine of claim 18 wherein the anti-rotation strap includes a braking element for frictionally engaging the tub.

23. The washing machine of claim 18 wherein the anti-rotation strap and tub include matable members to provide a mechanical look therebetween.

* * * * *